United States Patent [19]

Roy

[11] 4,319,750

[45] Mar. 16, 1982

[54] GOLF SHAFT HAVING CONTROLLED FLEX ZONE

[75] Inventor: Paul A. Roy, Poway, Calif.

[73] Assignee: Aldila, Inc., San Diego, Calif.

[21] Appl. No.: 34,414

[22] Filed: Apr. 30, 1979

[51] Int. Cl.[3] ..... A63B 53/10

[52] U.S. Cl. ..... 273/80 B; 273/DIG. 7; 273/DIG. 23

[58] Field of Search ..... 273/77 R, 80 R, 80 B, 273/80.9, DIG. 7, 23; 280/819; 43/18 GF; 428/53–58, 36, 377, 364, 109, 110; 114/90; 138/123, 124, DIG. 2

[56] References Cited

U.S. PATENT DOCUMENTS

| | | | |
|---|---|---|---|
| 1,921,068 | 8/1933 | Boyden | 273/80.9 |
| 2,050,554 | 8/1936 | Barnhart | 273/80 B X |
| 2,066,962 | 1/1937 | Cross | 273/80 B |
| 2,086,275 | 7/1937 | Lemmon | 273/80 B |
| 2,124,534 | 7/1938 | Barnhart | 273/80 B X |
| 3,269,743 | 8/1966 | Barreca | 273/80 R X |
| 3,933,364 | 1/1976 | With | 273/80 B X |
| 3,946,127 | 3/1976 | Eisenmann et al. | 273/DIG. 23 |
| 3,956,564 | 5/1976 | Hillig | 273/DIG. 23 |
| 3,974,012 | 8/1976 | Hogarth | 273/80 R X |
| 4,023,801 | 5/1977 | VanAuken | 273/80 B |
| 4,043,074 | 8/1977 | Airhart | 43/18 GF |
| 4,131,701 | 12/1978 | VanAuken | 273/80 R X |
| 4,133,708 | 1/1979 | Tokuno | 43/18 GF X |
| 4,135,035 | 1/1979 | Branen et al. | 273/80 R X |
| 4,171,626 | 10/1979 | Yates et al. | 428/36 X |

FOREIGN PATENT DOCUMENTS

| | | | |
|---|---|---|---|
| 337638 | 11/1930 | United Kingdom | 273/80.9 |
| 470178 | 8/1937 | United Kingdom | 273/80 B |
| 555027 | 7/1943 | United Kingdom | 273/80 B |
| 1261541 | 1/1972 | United Kingdom | 273/80 R |
| 1399941 | 7/1975 | United Kingdom | 273/80 R |
| 1504446 | 3/1978 | United Kingdom | 43/18 GF |

*Primary Examiner*—Richard J. Apley
*Attorney, Agent, or Firm*—John J. Leavitt

[57] ABSTRACT

Presented is a golf shaft designed to have a "kick" point or "flex" zone at a predetermined location along the length of the shaft. How and where the shaft bends or flexes during the down swing has a strong influence on how the club "feels" to the golfer. How and where the shaft bends during the down swing is determined by the construction of the golf shaft and presented herewith is a golf shaft structure and method of making it which controls the position of the flex point along the length of the shaft so that a variety of shafts having different flex characteristics may be manufactured to suit the dictates of individual players.

13 Claims, 32 Drawing Figures

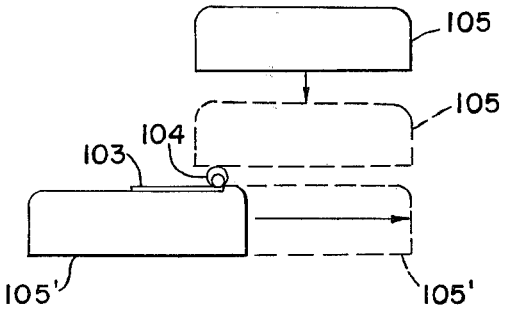
FIG. 21
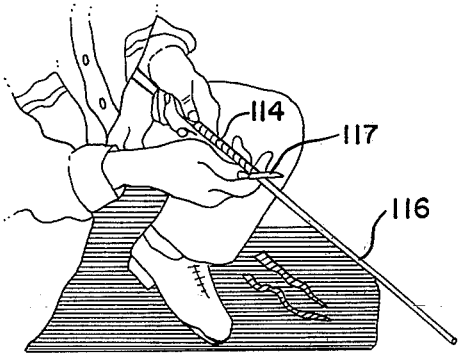
FIG. 24
FIG. 22
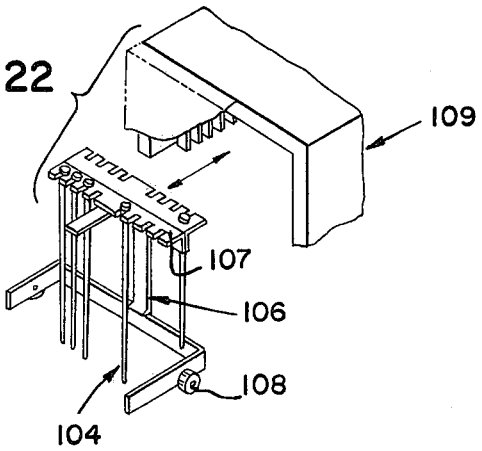
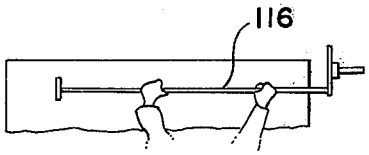
FIG. 25
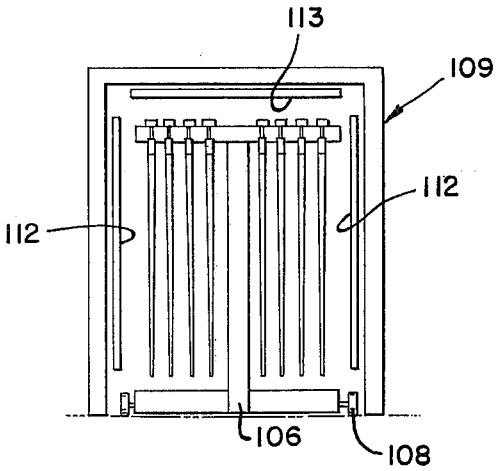
FIG. 23
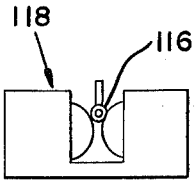
FIG. 26

GOLF SHAFT HAVING CONTROLLED FLEX ZONE

BACKGROUND OF THE INVENTION

1. Field of the Invention

This invention relates to golf club shafts, and particularly to a golf club shaft of the composite type designed to minimize the shock wave reaching the grip-end of the shaft when a ball is struck, and which possesses a flex point at a predetermined point along its length to control flexure of the shaft during the downswing of the club.

2. Description of Prior Art

Applicant is unaware of any prior art that teaches the concept described and claimed herein.

SUMMARY OF THE INVENTION

In terms of broad inclusion, the golf shaft of the invention is constructed in such a manner that it provides an impedance mismatch at a predetermined point along its length which determines the position of the flex zone along the shaft. The impedance mismatch relates to the shock wave that travels up the shaft when a ball is struck and results in golf club shafts fabricated with predetermined "feel" and flex characteristics. For instance, better golfers prefer shafts with a high flex zone, measured from the heel of the club head, whereas high handicapped golfers appear to derive greater benefits from clubs with shafts having a so-called lower flex point or zone, i.e., a flex point that is located closer to the heel of the golf club head. Accordingly, it is one of the objects of the present invention to provide a golf shaft constructed in such a way that the "feel" and flexing characteristics of the shaft are predetermined and controlled during manufacture.

It will of course be understood that all golf shafts flex to a certain degree over their entire length during a swing. However, it has been determined that it is possible by design of the golf shaft to control to a limited degree the overall curvature or flex action of a shaft. With steel shafts, this is done to a very limited degree by varying the step pattern and shaft wall thickness. Surprisingly, more definitive control and greater accuracy of location of the flex point is achieved with "composite" golf club shafts by close control of the manufacturing procedure. It should be understood that the term "composite" as used herein is intended to include shafts made up from fiber reinforced with a synthetic resinous material. Accordingly, one of the important objects of the present invention is the provision of a composite golf shaft fabricated from filamentary material embedded in a suitable synthetic resinous material and constructed in a manner to provide a predetermined impedance mismatch and flex point along the shaft.

Another object of the invention is the provision of prefabricated pre-impregnated blanks constituting prearranged laminations of pre-impregnated filamentary material, manufactured and packaged ready for use in the construction of golf shafts having a predetermined "feel" and flex point and which may be stored in assembled form for subsequent formation into a composite golf shaft.

It is believed that flex action or how and where the shaft bends or flexes during a down swing, is an important influence on the "feel" transmitted to the golfer. Obviously, the sensation of "feel" in a golf club is a subjective quality, but it appears that all golfers have experienced the phenomenon that certain clubs "feel" better than others. Associated with "feel" or "good feel" generally are better shots and accompanying lower scores. One of the factors that controls the "feel" of a club is the vibration or shock wave transmitted up the shaft from the club head when a golf ball is struck. Accordingly, another object of the present invention is to provide a golf club shaft that incorporates at a predetermined point along its length an impedance mismatch for such shock wave which is produced by incorporation of a quantity of material that is different from the rest of the material from which the shaft is made, and which functions to impede or substantially damp out the shock wave transmitted up the shaft.

It is believed by golfers that total energy imparted to the ball upon impact is one of the factors that influences the distance a golf ball will travel. A component part of the total energy imparted to the ball is the strain energy stored by the golf club which, when released in the instant following impact, works to propel the ball farther. Accordingly, another object of the invention is the provision of a golf shaft incorporating means for increasing the strain energy storage of the golf shaft.

It is also known that a reduction of the recoil or torque of a golf club head upon impact with the ball has an effect on the total energy imparted to the ball and to the direction in which the ball will fly. Recoil or torque is controlled in large measure by the flexibility of the tip of the golf shaft next adjacent the club head, and it is therefore another object of the present invention to provide a golf club shaft in which means are provided to control the loft of the club at the instant of impact and simultaneously control "closing" of the face of the club to thus provide better control of the direction of flight of the ball.

It has been found in laying up the laminations for a composite golf club shaft fabricated from various layers of fiber materials embedded in a suitable synthetic resinous material, that the location of the flex point or zone and the "feel" may be predetermined by the pattern of the laminations or layers from which the golf shaft is ultimately formed. Accordingly, another object of the present invention is the provision of a preassembled "layup" of interrelated and interengaging layers of pre-impregnated filamentary material arranged to produce a hollow tapered golf shaft having a flex point in a predetermined zone when formed into a completed golf shaft.

A still further object of the invention is the provision of a golf shaft fabricated from at least two different materials, one having a high modulus of elasticity while the other has a low modulus of elasticity, the two materials being interengaged and laminated in a manner to provide an interface between the two materials which determines the location of the flex point of the shaft.

A still further object of the invention is to provide a golf shaft in which the flex point of the shaft is controlled by providing a shaft that is necked down over a length of from 2" to 12" to determine the location of the flex point.

The invention possesses other objects and features of advantage, some of which, with the foregoing, will be apparent from the following description and the drawings. It is to be understood however that the invention is not limited to the embodiment illustrated and described since it may be embodied in various forms within the scope of the appended claims.

BRIEF DESCRIPTION OF THE DRAWINGS

FIG. 21 is a schematic view illustrating how the layup of FIG. 19 is rolled onto a mandrel on a rolling table to form a hollow tapered tube.

FIG. 22 is a schematic view illustrating a multiplicity of the rolled layups on separate mandrels with the mandrels suspended on a rack preparatory to placement in an oven for processing.

FIG. 23 is a schematic view illustrating a rack of the rolled layups positioned inside an oven.

FIG. 24 is a perspective view illustrating one method of removing constrictive cellophane wrap from the exterior surface of the processed rolled layups.

FIG. 25 is a perspective view in plan illustrating the manner of cutting and trimming the shafts to appropriate lengths.

FIG. 26 is a diagrammatic view illustrating the method of polishing the exterior surface of a completed shaft.

DESCRIPTION OF THE PREFERRED EMBODIMENT

Figure 1:
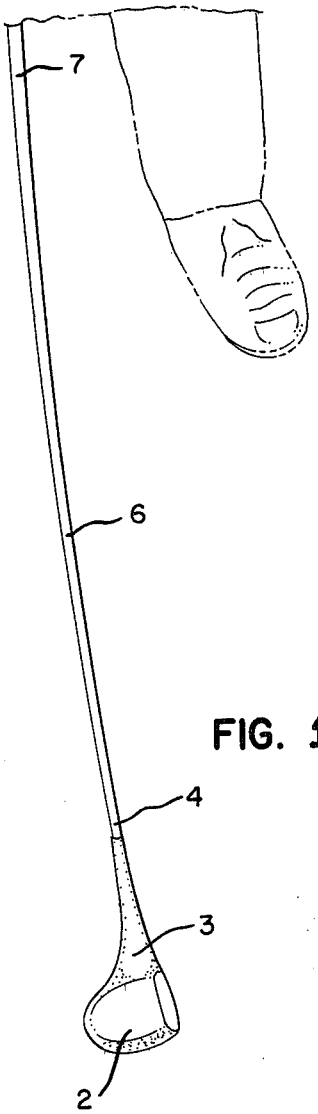
FIG. 1 is a fragmentary perspective view illustrating the conventional forward flexure of a golf club shaft at the instant of impact of the club head with a golf ball.
Figure 2:
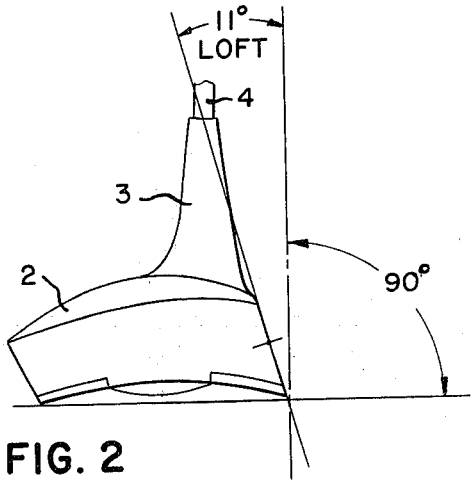
FIG. 2 is a fragmentary front elevational view illustrating the club head loft angle manufactured into most conventional golf club heads.

As indicated above, it is one of the purposes of the present invention to provide a golf club shaft and a method of manufacture of that golf club shaft, which possesses predetermined flexure characteristics so that individual golfers possessing individual characteristics of strength, weakness, consistency, etc., in relation to their particular method of swinging a golf club can have a broader range of golf clubs from which to select a club that matches their particular characteristics. Upon analysis, it is surprising the number of different parameters that must be considered in the design of a golf club and a golf club shaft. Not the least of these is the flexibility of the shaft and the pattern of such flexure. Another important characteristic of a golf club is the "feel" of the club in the hands of a particular golfer upon the impact of the club head with a golf ball. The quality of "feel" at least in some respect is determined by the frequency and intensity of vibrations transmitted up the golf shaft from the club head as a result of impact of the club head with the golf ball. It is generally conceded that golf clubs equipped with metal shafts will possess more intense "feel" because the metal shaft imposes less of an impedance to the vibrations transmitted up the shaft to the grip end thereof. In like manner, it is generally conceded that "composite" shafts, i.e., shafts fabricated from filamentary material embedded in a suitable plastic matrix, provide a damping effect on the vibrations and generally have a "softer" quality of "feel". Obviously, this quality of "feel" is a very subjective quality, it is difficult to define in any scientific terms, and it is probable that the very same shaft would possess a different "feel" in the hands of two different golfers.

The quality of flexure in a golf shaft, however, is a quality that is objective in that it may be calculated and the degree and types of flexure in a golf shaft can be observed objectively and measured scientifically and steps can be taken during the manufacturing process of a composite golf shaft to control the flexure characteristics of a golf shaft. Referring to FIGS. 1 through 4C on Sheet 1 of the drawings an attempt has been made to illustrate some of the effects of flexure in a golf shaft. Thus, the golf club comprises in these illustrations a club head 2 especially formed into a characteristic configuration from a block of persimmon wood where the club, as illustrated, constitutes a "wood", or fabricated from an appropriate metal where the club constitutes an "iron". The shaft is rigidly mounted in the hosel 3 of the club head, and is preferably tapered from a relatively small diameter at the end 4 secured to the hosel, through an intermediate shaft portion 6 terminating at its upper end in a grip end portion 7 constituting approximately the last ten or twelve inches adjacent the larger diameter end of the shaft. The grip end portion 7 of the shaft is provided with a grip 8 which is generally fabricated from soft pliable material applied to the grip end portion of the shaft and intended to increase the diameter of the shaft to a diameter that is comfortable to grip with the human hand, and to also damp some of the vibrations that are transmitted up the shaft from impact of the club head with a golf ball in an attempt to control the "feel" of the golf club.

Figure 3A:
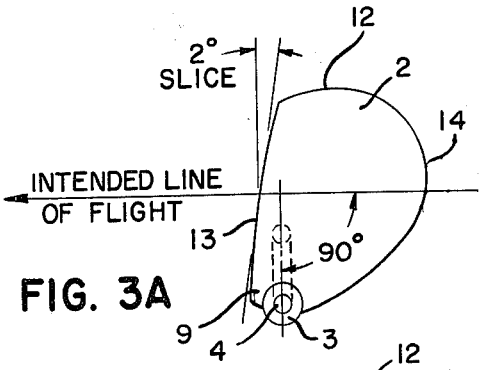
FIG. 3A is a fragmentary plan view illustrating the angle of the face of the golf club in relation to the intended line of flight when the club face is "open".
Figure 3B:
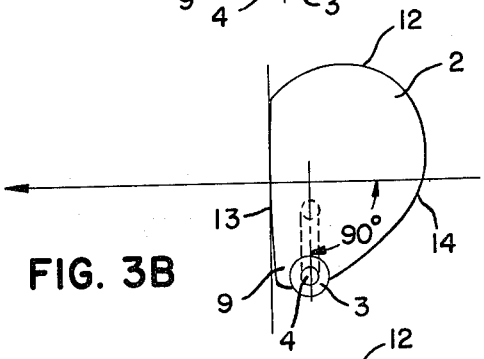
FIG. 3B is a view similar to FIG. 3A but showing the face of the golf club squared with the intended line of flight of the golf ball.
Figure 3C:
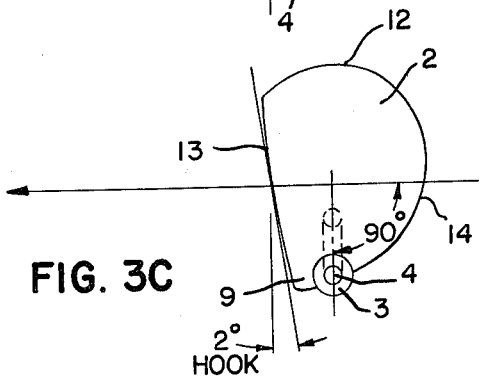
FIG. 3C is a view similar to FIGS. 3A and 3B but illustrating the golf club face in a "closed" condition in relation to the intended line of flight of the ball.
Figure 4A:
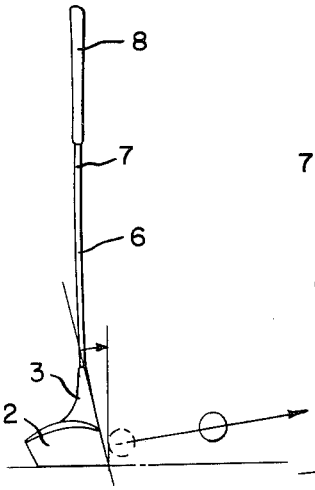
FIG. 4A is a front elevational view illustrating the relatively lower trajectory of a ball impelled by a stiff shaft.
Figure 4B:
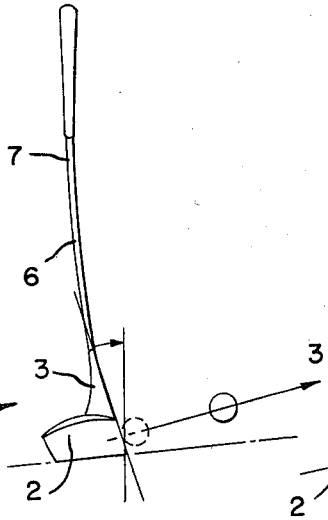
FIG. 4B is a view similar to FIG. 4A but showing schematically the flexure of a medium flex shaft and the resulting greater head rotation and increased loft angle of the face of the club.
Figure 4C:
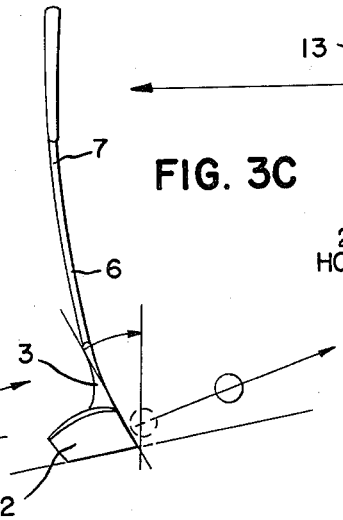
FIG. 4C is a view similar to FIG. 4B, showing schematically the effect of a flexible shaft on the loft angle and higher trajectory of the ball.

With this makeup of the golf club, it will be seen that when the golf club is swung through an arc that frequently encompasses 360° or more at velocities approaching 100 miles per hour at impact of the golf club with the golf ball, many and varied types of stresses are applied to the golf shaft. One of the stresses that is perhaps most importantly significant from the stand point of consistency in his golf swing on the part of the golfer is the centrifugal force generated by swinging the club head through an arc at velocities approaching 100 miles per hour. As illustrated in FIGS. 3A–3C, a golf club is provided with a heel end 9 lying next adjacent the hosel of the club head at the base of the golf shaft and a toe end 12 directly opposite the heel and spaced therefrom sometimes as much as three inches or more. Additionally, as illustrated in the plan views FIGS. 3A through 3C, a continuation of the longitudinal axis of the golf shaft passes through the club head closer to the front striking face 13 of the club head than it does to the rear edge 14 which as illustrated bulges away from the front face. It may thus be said that the toe to heel length of the club head constitutes a lever arm which tends to rotate about an axis perpendicular to the longitudinal axis of the shaft when the club is swung through a tight circular arc at velocities approaching 100 miles per hour. Since the small diameter end of the golf shaft is rigidly attached to the hosel of the club head, and since the grip end portion of the shaft is tightly held by the golfer, the effect of such rotational moment about a horizontal axis is to cause the golf shaft to bow or flex forwardly as indicated in FIG. 1 to some degree, and as illustrated in somewhat more detail in FIGS. 4A through 4C. Obviously, the relative stiffness or flexibility of the shaft will determine the degree of such flexure. Thus, as illustrated in FIG. 4A through 4C, a stiff shaft will flex a smaller amount than a medium shaft and both of these will flex less than a shaft designed to have high flexibility. As will be seen from FIGS. 3A through 4C, the effect of flexibility in the shaft produces a very direct result in how the ball is struck. Thus, with a rigid shaft as illustrated in FIG. 4A, the loft of the club will remain relatively unchanged, or if changed, only by a degree or two. This will result in a lower trajectory for the ball when struck. Additionally, a rotational moment about the longitudinal axis of the shaft is less likely to occur and it is probable that the golfer will strike the ball in such a manner that the striking face 13 of the club head will be "open" in relation to the intended line of flight of the golf ball and the ball will slice to the right when struck by a right-handed golfer. A different golfer, or a different degree of stiffness or flexibility in the shaft may produce the square relationship illustrated in FIG. 3B where the ball striking face 13 is essentially perpendicular to the intended line of flight of the golf ball. In another circumstance, where a "whippy" or highly flexible shaft is used, it might be found that upon impact of the club head with the golf ball the club striking face 13 assumes a "closed" condition in relation to the intended line of flight of the ball with the result that the ball is apt to hook to the left when struck by a right-handed golfer. It will thus be seen that the degree of flexibility and the nature of that flexibility is extremely important in the way in which a ball will "fly" when struck by the club head.

Figure 5A:
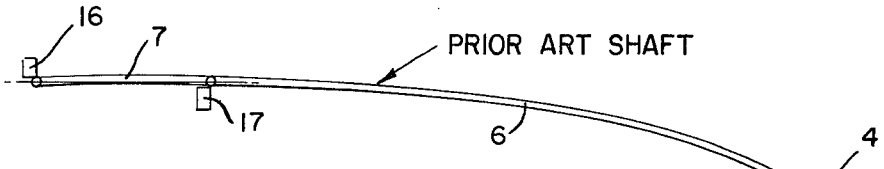
FIG. 5A is a schematic view illustrating the flexure pattern of a commercially available shaft having a relatively flexible tip portion upon application of a force F.
Figure 5B:
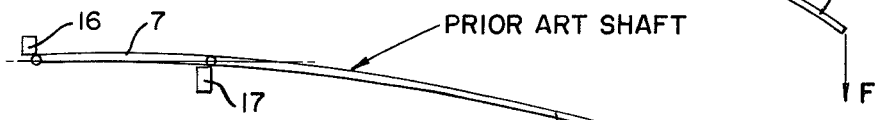
FIG. 5B is a view similar to FIG. 5A but showing another commercially available golf shaft manufactured to provide medium flexibility and showing the degree of flexure over the entire length of the shaft upon application of a force F.
Figure 5C:
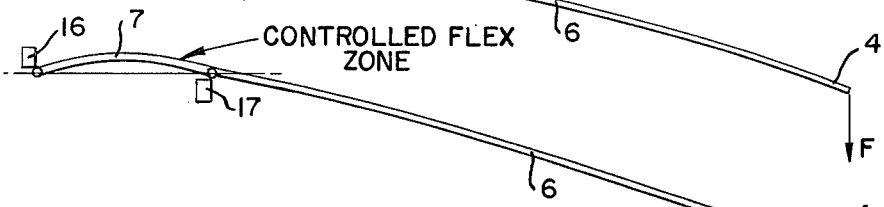
FIG. 5C is a view similar to FIGS. 5A and 5B, but showing the shaft forming the subject matter of the present invention and illustrating schematically and to an exaggerated degree for illustration purposes that most of the flexure of the shaft occurs between the fulcrum of the shaft and the butt end of the shaft upon application of a force F at the tip.

Flexure in a golf shaft is not measured merely by the degree of flexure measured from one end of the golf shaft to the other. This is of course an important parameter for consideration, but also and perhaps even more important is a determination of where along its length will a golf club shaft flex and to what degree. To illustrate this parameter, reference is made to FIGS. 5A through 5C where different flexure patterns of different shafts of essentially the same length are illustrated schematically. Thus, to test the flexure of a golf shaft during the course of its manufacture and to determine what its flexure characteristics are, a shaft is placed into a test device with the butt or grip end portion 7, and generally the extreme end thereof locked under an abutment 16 with a fulcrum placed under the shaft at a point spaced typically from 10 to 12 inches from the abutment 16. A force F is then applied to the tip end 4 of the shaft, usually through an appropriate pneumatic or hydraulic device equipped with a gauge to indicate the pounds of pressure applied and an appropriate valving mechanism to control that quantity. In the prior art shaft illustrated in FIG. 5A, it will be noted that with a given force F maximum flexibility occurs at the tip end of the shaft with the flexure pattern diminishing in degree toward the butt end of the shaft. In the prior art shaft illustrated in FIG. 5B, on the other hand, the flexure pattern is such that the force F imposes an almost uniform flexure over the entire length of the shaft. In FIG. 5C, a flexure pattern derived from a golf shaft manufactured according to the subject matter of this invention is illustrated, indicating that the golf shaft is relatively stiff between the tip end of the shaft and the fulcrum point, but that high flexibility is designed into the shaft in the butt section illustrated between the abutment 16 and the fulcrum 17.

It has been found that the flexure of the shaft illustrated in FIG. 5C is so abrupt and is controlled so closely that the transitional point between the butt section of high flexibility and the shaft section of relatively low flexibility may be considered the "hinge" point and is susceptible of being controlled in various ways as will hereinafter appear.

Figure 6:
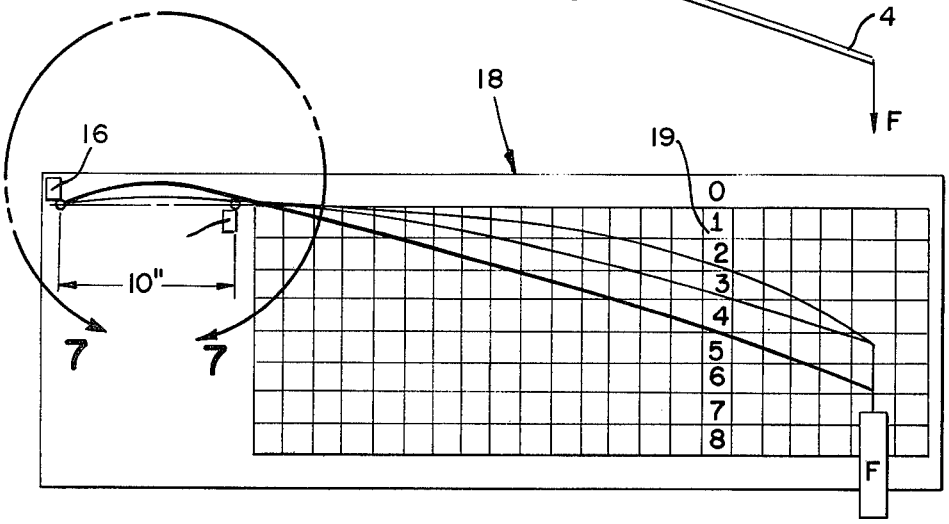
FIG. 6 is a diagrammatic view in which the shafts illustrated in FIGS. 5A through 5C are superimposed on a graph to better illustrate and compare their respective flexure patterns.

In the designation of the flexure characteristics of a golf shaft, the same test apparatus that is utilized in connection with testing the degree of flexure of a golf shaft, incorporates a graph like background designated in FIG. 6 generally by the numeral 18 and including a series 19 of indicia from 0 to 8 indicating degrees of flexure of the shaft. Thus, as seen in FIG. 6 where the shafts illustrated in FIGS. 5A through 5C are shown superimposed over the graph 18, the prior art shaft illustrated in FIG. 5A indicates a flexure characteristic of "2" whereas the intermediate shaft illustrated in FIG. 5B indicates a flexure characteristic of "3" and the shaft illustrated in FIG. 5C and constituting a shaft manufactured according to the subject matter of this invention indicates a flexure characteristic between 4 and 5 and generally closer to 5. It will thus be seen that with the two prior art shafts illustrated in FIGS. 5A and 5B almost all of their flexibility is provided in the length of shaft between the tip end 4 and the fulcrum 17. Thus of course is indicated by the degree of curvature of the shaft as illustrated against the graph 18. On the other hand, the shaft illustrated in FIG. 5C, and constituting the subject matter of this invention, clearly displays its maximum flexibility in the area between the fulcrum 17 and the abutment 16. It should of course be understood that for purposes of illustration the degree of flexure in the area between the fulcrum 17 and the abutment 16 in the illustrations has been exaggerated.

Figure 7:
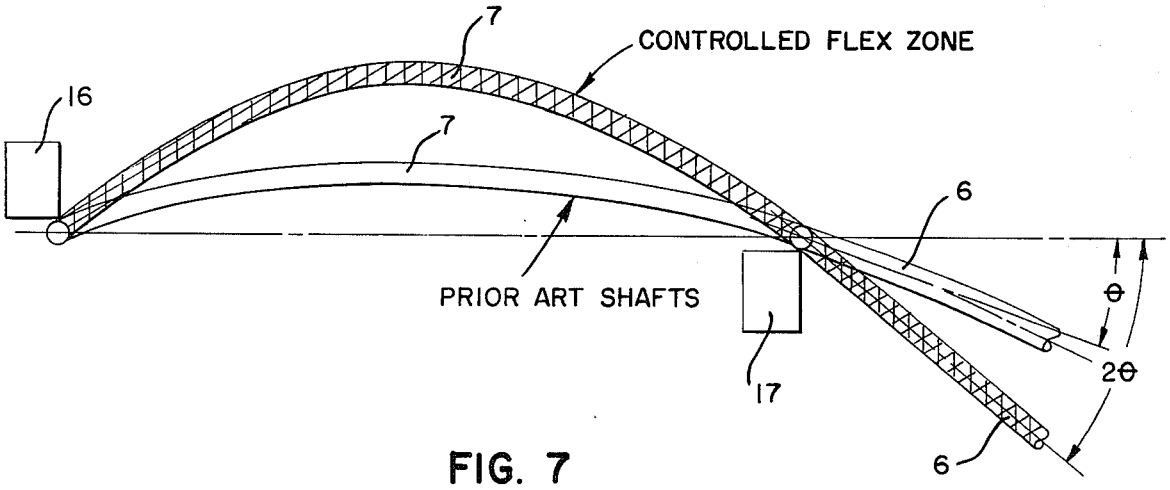
FIG. 7 is an enlarged fragmentary view of the small section of the butt portions of the shafts indicated by the line 7—7 in FIG. 6 and illustrating schematically and to an exaggerated degree the flexure in the butt section of the shaft of this invention over a ten inch butt portion as compared with conventional shafts.

The exaggeration of such flexure between the fulcrum 17 and the abutment 16 is perhaps more apparent in FIG. 7 where it is seen that the increased flexure of the controlled flex zone of the golf shaft forming the subject matter of this invention results in the shaft portion 6 to flex through an angle $2\theta$ measured between a horizontal plane passing through the "hinge" point at the fulcrum 17 and the longitudinal axis of the shaft, as compared with only half that amount of angular displacement in the prior art shafts.

Figure 8:
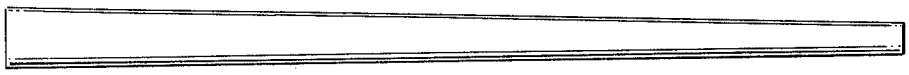
FIG. 8 is a plan view illustrating the general tapered configuration of a conventional golf shaft.
Figure 9:
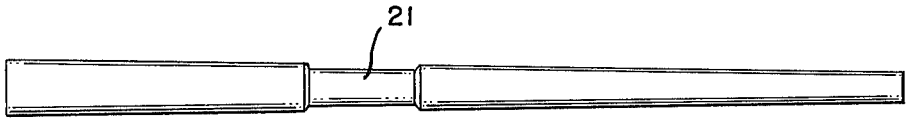
FIG. 9 is a plan view of a golf shaft having a "necked down" portion to control flexure of the shaft.

As indicated above in connection with FIG. 1 and FIGS. 4A through 4C, most composite golf shafts possess a configuration that constitutes an elongated truncated cone tapering from a small diameter end to a large diameter end uniformly over its entire length. This shaft configuration is illustrated in FIG. 8. Such a shaft possesses a constant taper over its entire length and when flexed at the tip end as exhibited in FIG. 5B will exhibit a uniform curvature over its entire length. In the shaft configuration illustrated in FIG. 9, a necked-down portion 21 has been provided that may be from 2 to 6 inches long and which reduces the effective diameter of the shaft at a selected distance from the butt end of the shaft. Such a necked down portion of the shaft will bend more than the remainder of the shaft in a tip flex test and as a result, the flexure along this necked down portion of the shaft will dominate the flex characteristics of the shaft. The shaft can of course be constructed of one material, and by virtue of its geometry, the flex pattern is controlled to a desired degree and configuration. It should of course be understood that all golf shafts flex to some degree over their entire length during a swing, and that it is possible by design to control to a limited degree the overall curvature (flex action) of a shaft. With conventional steel shafts such control has been attempted to a very limited degree by varying the step pattern along the shaft and by varying the wall thickness of the shaft. This behavior in steel shafts is illustrated by the prior art shafts illustrated in FIGS. 5A and 5B, both of which constitute steel shafts. As indicated previously, the curvature illustrated on these shafts has been drawn out of scale to illustrate the point.

I have found that in connection with composite shafts for clubs there is another way of controlling the degree of flexure of a golf shaft and for controlling the pattern of such flexure over the length of the shaft. Additionally, I have found that through the exercise of my discovery in the formation of the golf shaft, I can control the "feel" of the golf shaft so as to thus allow the production of golf shafts having characteristics that may be "matched" with the characteristics of a given golfer. I have discovered the surprising fact that when two dissimilar materials are utilized to fabricate a golf shaft, and interengaged in specific ways to produce a golf shaft, not only can I control the degree of flexure and flexure pattern of a golf shaft, but I can control the "feel" of that golf shaft when ultimately incorporated into a golf club. My surprising discovery is based on the fact that when a force is applied to an elastic body, waves of stress and deformation radiate from the loaded region (golf club head) and travel at finite velocities of propagation throughout the length of the golf shaft. The magnitude and propagation velocities of these stress waves in the elastic body is a function of the elastic properties of the elastic body. If the progressive plane wave in an elastic body impinges on the boundary of a second elastic body having nonequivalent elastic properties, a reflected wave is generated in the first elastic body and a transmitted wave is generated in the second elastic body. The ratios of the respective intensities and stress amplitudes of the reflected and transmitted waves to those of the incident wave depends on the characteristic impedances of the two elastic bodies.

Figure 10:
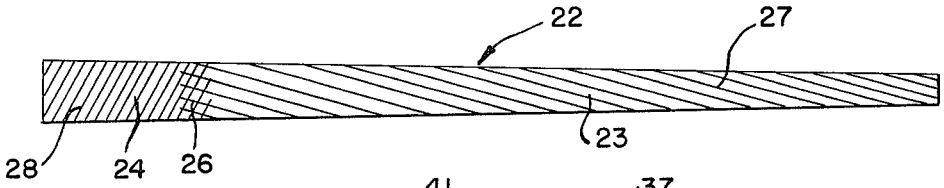
FIG. 10 is a plan view of a ply according to this invention made up of pre-impregnated filament material as used for the golf shaft of the present invention and illustrating the use of two different filamentary materials interengaged adjacent one end of the ply.
Figure 11:
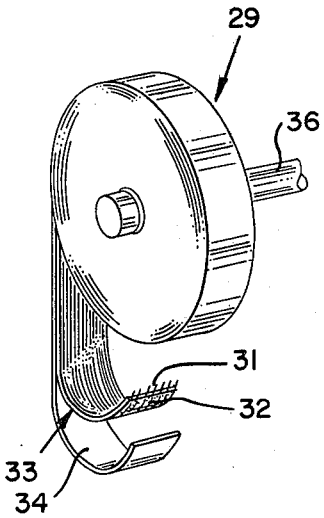
FIG. 11 is a perspective view illustrating a roll of filamentary material pre-impregnated with an appropriate synthetic resinous material and provided with a protective and removable backing sheet.

To illustrate this condition, reference is made to FIG. 10 of the drawings which illustrates in plan a single layer or ply designated generally by the numeral 22 made up of preimpregnated filamentary material such as is commonly used for golf shafts of the composite type, but which is modified in that one portion 23 constituting the major length of the shaft is fabricated or formed from one material, while a shorter section 24 is interengaged and intimately bonded to the first portion 23 but is fabricated from a different material. It should be understood that in connection with the ply 22, and it is stated that the portion 23 is fabricated from "one material," it is meant that one specific type of filamentary material such as glass fiber, carbon graphite fiber or carbon graphite filaments or boron filaments are used in conjunction with an appropriate softer matrix material constituting a synthetic resinous material such as one of the epoxies. Thus, a composite material made up of two separate parts, but functioning as one, is formed. The bonded interface between the long portion 23 of the ply and the short portion 24 of the ply is indicated at 26 and constitutes a mechanical overlapping of the two portions for a predetermined distance, an overlap of one-half inch being satisfactory. In the ply 22, the diagonal lines 27 in portion 23 indicate individual filaments oriented at an angle to the longitudinal dimension of the ply. In the same manner, the diagonal lines 28 in the shorter portion 24, indicate individual filaments orientated at an angle to the longitudinal axis of the ply. It will of course be understood, as will hereinafter be explained, that the individual filaments 27 and 28 in these two ply portions may be arranged in the opposite direction, or may be arranged so as to have an essentially 0° orientation with respect to the longitudinal dimension of the ply. Preferably, the filaments 27 in the longer portion of the ply constitute carbon graphite filaments or boron filaments, while the filaments 28 in the shorter section 24 of the ply constitute glass fibers or filaments, the filaments of both portions being imbedded in an appropriate synthetic resinous matrix. These materials are purchased in roll form as indicated in FIG. 11, where the roll is designated generally by the numeral 29 and comprises a layer 31 of filaments, either carbon graphite or boron, arranged parallel to one another and held together and in such longitudinal orientation by a layer of synthetic resinous material 32. Attached removably to the composite layer designated generally by the numeral 33 comprising the filament layer and the synthetic resinous matrix is a release paper layer 34 which permits the elongated strip to be rolled into a roll form so that it may be supported on an appropriate shaft 36 for facility in dispensing selected lengths of the material. It has been found that twenty-five pound rolls of either carbon graphite or boron composite material may be purchased from commercial vendors, with the carbon graphite filaments each having a diameter of approximately (7) microns, thus producing a tape approximately four inches wide and of indefinite length made up of approximately 130,000 individual carbon graphite fibers. When the tape is fabricated from boron filaments, the boron filaments are of significantly larger diameter, up to approximately 0.004", and obviously thus produce a tape having fewer filaments for a given cross sectional dimension.

Figure 12:
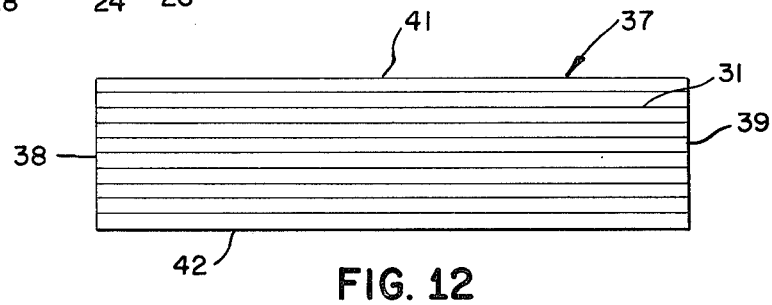
FIG. 12 is a plan view of a single layer blank of pre-impregnated filamentary material having the filamentary material extending longitudinally at approximately 0° to the longitudinal dimension of the blank.

FIG. 12 illustrates a blank designated generally by the numeral 37 and cut from the roll illustrated in FIG. 11 to possess parallel end edges 38 and 39 and parallel side edges 41 and 42. As previously stated in connection with the description of FIG. 11, the elongated filaments 31 in this view (FIG. 12) are represented by the elongated lines lying parallel to each other and extending parallel to the longitudinal edges 41 and 42. In this description, such structure as illustrated in FIG. 12 constitutes a "blank" and from such blank there is cut the "plies" as will hereinafter be explained.

Figure 13:
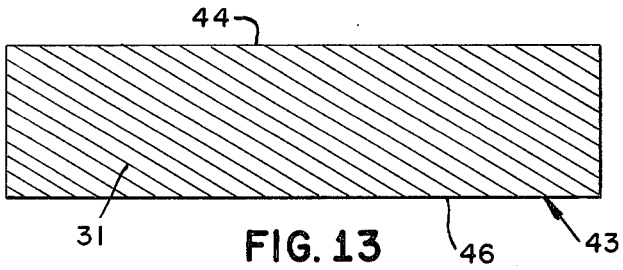
FIG. 13 is a single layer blank similar to FIG. 12 but having the filamentary material arranged at an angle of approximately 30° to the longitudinal dimension of the blank.

In FIG. 13, there is illustrated a blank 43 in which the filaments 31 are angularly disposed to the longitudinal edges 44 and 46 at any selected angle commensurate with the effect sought. Thus, the torsional stiffness of a shaft incorporating plies but from a blank such as 43 will be determined by the angle of the filaments to the longitudinal dimension of the ply. In general, the greater the angle measured between 0° and 90° the greater the stiffness.

Figure 14:
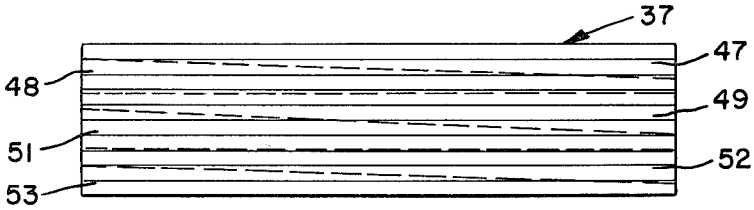
FIG. 14 is a diagramatic view illustrating in full lines the blank of FIG. 12 and illustrating in broken lines the patterns of a plurality of plies that are derived from one blank having 0° orientation of the elongated filaments.
Figure 15:
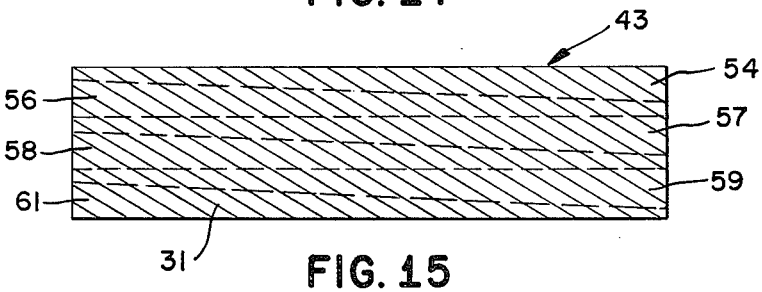
FIG. 15 is a view similar to FIG. 14 illustrating the manner of deriving multiple plies from a single blank of filamentary material in which the filaments are angularly oriented with respect to the longitudinal dimension of the blank.

The method of securing individual plies from these two types of blanks 37 and 43 is illustrated in FIGS. 14 and 15 where it is shown with respect to the blank 37 having 0 degree orientation of filaments 31 six separate plies 47–49 and 51–53 of appropriate transverse dimension to produce appropriately tapered longitudinal edges are secured from a single blank. In FIG. 14, the longitudinal edges of the intermediate plies cut from the blank are illustrated by broken lines.

Figure 16:
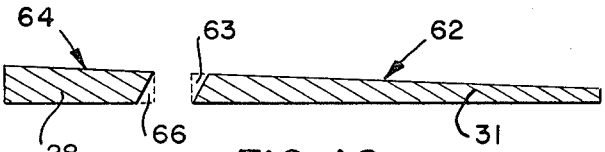
FIG. 16 is a composite plan view that illustrates two complimentary ply portions of different materials arranged in spaced end-to-end relationship prior to overlapping and bonding to create a high impedance transitional zone in the ply which when incorporated in a golf shaft defines the flex point of the shaft.

With respect to the blank 43 illustrated in FIG. 15, in which the filaments 31 are oriented at a predetermined angle to the longitudinal dimension of the blank, the same method of cutting longitudinally along the blank is utilized to produce six separate plies 54–59 and 61 as illustrated. Again, for purposes of illustration, the intermediate longitudinal edges of the plies are indicated by broken lines. It should of course be understood that in FIGS. 14 and 15 the plies are not actually separated one from the other, the broken lines being used merely to illustrate the position in the blank from which the plies are derived. In FIG. 16 there is illustrated one of the plies designated generally by the numeral 62 having angularly oriented filaments 31 and having one corner portion 63 as shown in broken lines in FIG. 16 trimmed from the wide end of the ply. Forming a dimensional continuation of the ply portion 62 is a shorter ply portion 64 also having angularly oriented filaments 28 as discussed in connection with FIG. 10 above, and also having a corner portion 66 trimmed from the end adjacent the corner portion 63, the two trimmed ends of the ply portions 62 and 64 being trimmed at the same angle so as to provide a uniform overlapped section 26 as depicted in FIG. 10. It should of course be understood that with respect to FIG. 16, the ply portions 62 and 64 are fabricated from different filamentary materials as will hereinafter be explained.

Figure 17:
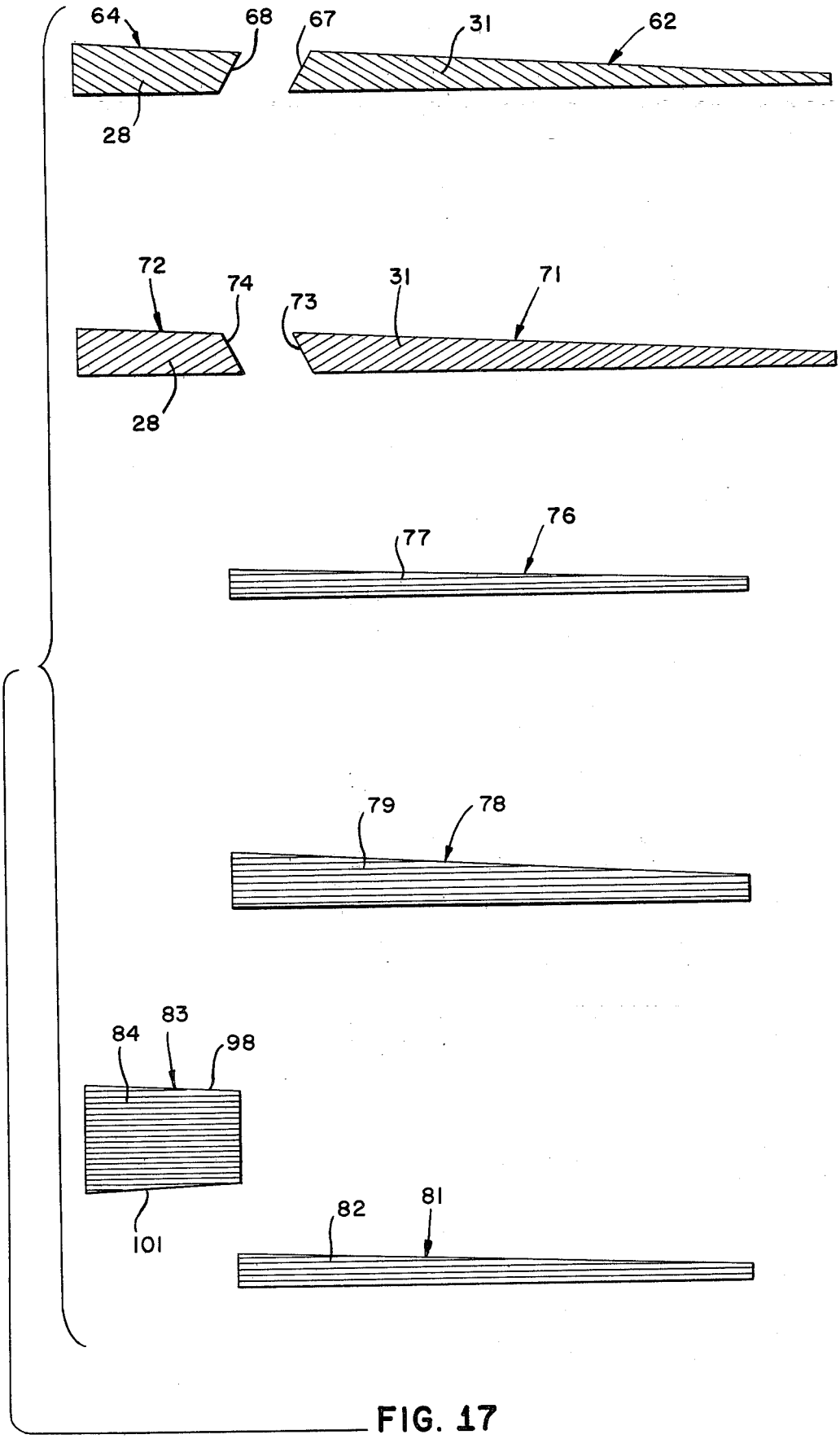
FIG. 17 is a composite view illustrating an arrangement of the different plies and portions of plies shown individually and prior to assembly in a "layup" for one embodiment of the invention.

The foregoing has provided a comprehensive explanation of the results sought to be achieved by the method of construction forming the subject matter of this invention, and has explained in detail the different types of materials utilized in the construction. Also important in connection with the invention is the method by which those materials are arranged during the manufacturing procedure to accomplish the end result, namely, the production of a golf shaft having a controlled flex zone. Referring to FIG. 17, there is there illustrated in composite form an arrangement of the different plies and portions of plies shown individually and prior to assembly in a "layup" for one embodiment of the invention. Starting at the top of the view and working downwardly, the ply portion 62 may be taken to be the same as that illustrated in FIG. 16, having angularly oriented filaments 31 of carbon graphite held in an epoxy matrix. In this view, by selection, the filamentary material is illustrated as lying at a 30° angle to the longitudinal dimension of the ply portions 62. Additionally, the wider end of the ply is provided with a diagonal edge 67 that lies perpendicular to the filaments 31. Complimenting and constituting a dimensional extension of the wide portion 62 is the ply portion 64 which may be taken to be similar to the ply portion 64 illustrated in FIG. 16. As there shown, this ply portion is provided with filaments 28 orientated at an angle of 30° to the longitudinal dimension of the ply and the narrow or apex end of the ply portion 64 is provided with a diagonal edge 68 as shown which angularly compliments the diagonal edge 67 of the associated ply portion 62. A significant difference between the ply portion 62 and the ply portion 64 is the fact that the filaments or fibers utilized in the ply portion 64 constitute fiber glass embedded or carried in an epoxy matrix as opposed to the carbon graphite filaments carried in the ply portion 62. Obviously, as may be determined from any number of publications, the modulus of elasticity of the fiber glass is significantly lower than the modulus of elasticity of the carbon graphite filaments. This dissimilarity in the individual ply makeup is an important factor in achieving the results sought to be achieved by this invention. To provide some idea of dimensional characteristics of the ply portion 62 and 64, the overall dimension of the ply in completed form found to be satisfactory is 1.25"×2.8×35.75".

The next successive ply is designated generally by the numerals 71 and 72, and the ply is made up of exactly the same materials are the ply portions 62 and 64, however the filaments 31 and 28 in this ply are orientated 30° in the opposite direction, as are the end edges 73 and 74. This ply constitutes the second ply that will be applied to the composite structure as will hereinafter be explained.

The third ply to be applied is designated generally by the numeral 76 and as there shown, constitutes an elongated ply having filaments 77 extending longitudinally of the ply and having generally a 0° orientation with the longitudinal dimension of the ply. This ply, which constitutes the third ply to be applied to this structure, utilizes filaments 77 that are fabricated from boron having a diameter up to approximately 0.004" and embedded or carried in an epoxy matrix as is well known in industry. From a dimensional point of view, this ply is approximately 34.5" long and 0.8" at its apex end and 1.6" wide at its opposite end.

The fourth ply, and optionally the last ply, is designated generally by the numeral 78 and constitutes a ply having a length of approximately 34.5" fabricated from carbon graphite filaments 79 arranged in a 0° orientation to the longitudinal dimension of the ply. This ply is approximately 2.5" wide at its apex end and approximately 4.75" wide at its opposite end. These four plies, as will subsequently be explained, are wound upon an appropriate mandrel to provide at least 8 layers or laminations that determine the wall thickness of the completed shaft.

Optionally, a fifth ply may be used designated generally by the numeral 81 and formed from carbon graphite fibers 82 arranged in a 0° orientation and having an overall length of approximately 34.5" and a 1" dimension at its apex and a dimension of approximately 1.8" at its opposite end. As illustrated, the longitudinal edges of the ply portion 83, formed from glass fibers 84 embedded in synthetic resinous material, taper toward the narrow end of the piece.

Figure 18:
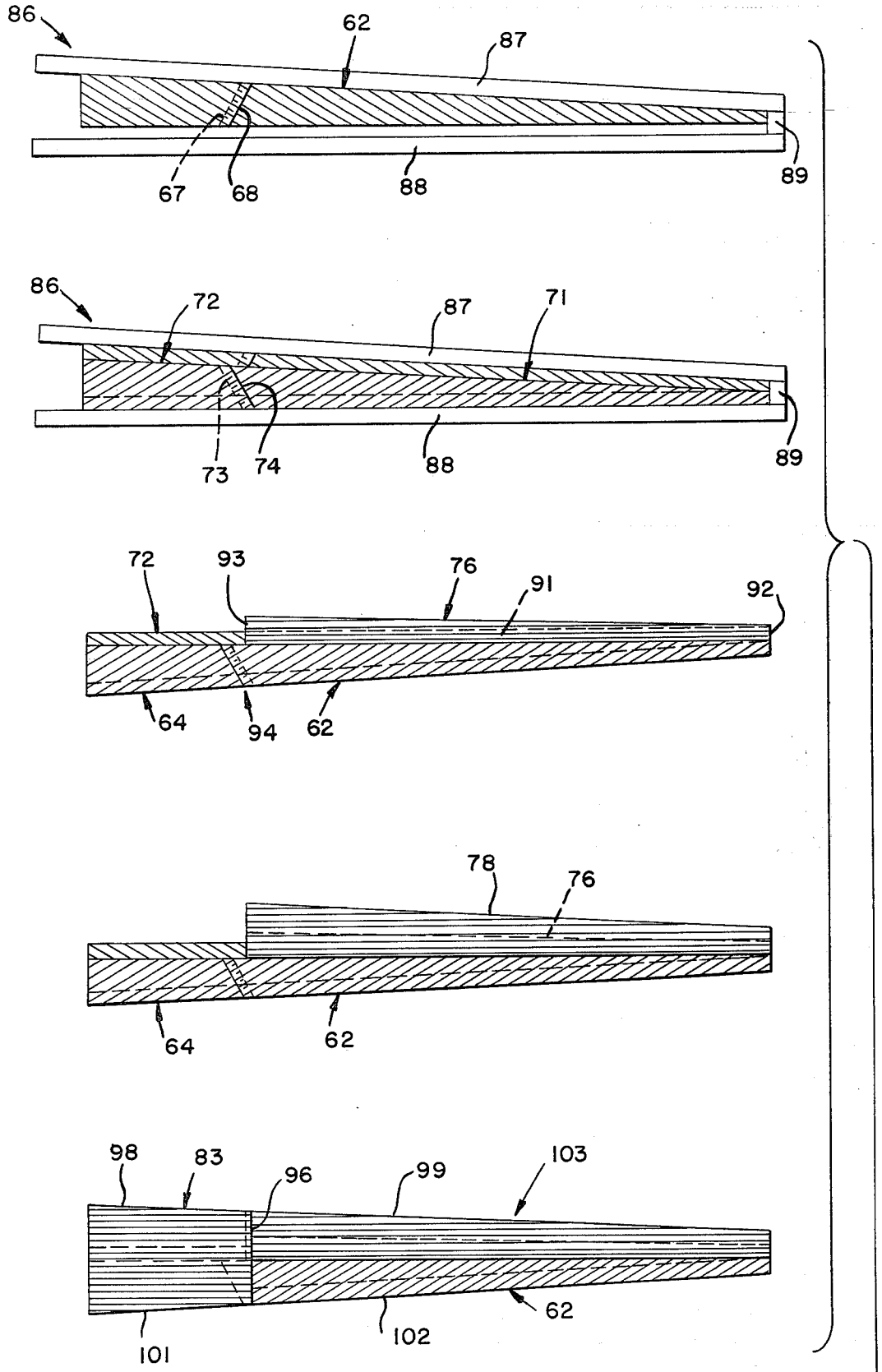
FIG. 18 is a composite view illustrating in diagrammatic form the jig arrangement and the method and sequence in which the different plies are assembled to form a composite "layup" of the shaft material.
Figure 19:
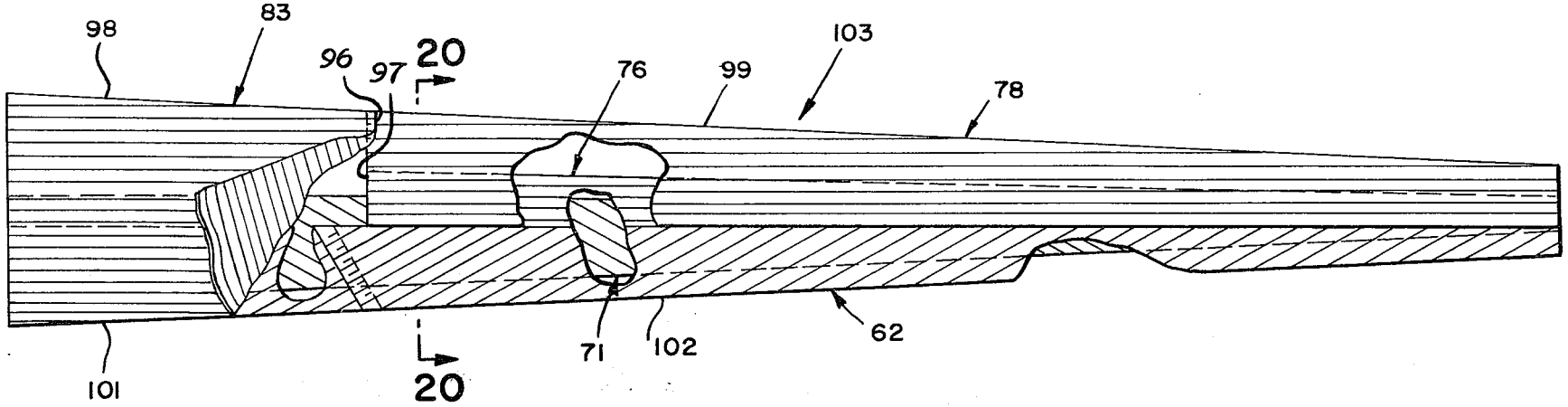
FIG. 19 is a plan view of the completed composite layup, with portions of the various layers broken away to disclose the underlying structure.
Figure 20:
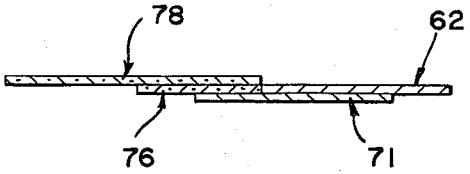
FIG. 20 is a vertical cross-sectional view taken in the plane indicated by the line 20—20 in FIG. 19.

These individual components as illustrated in FIG. 17 are then arranged, interconnected and overlayed in the manner illustrated in FIGS. 18 and 19 to produce a "layup" that for purposes of this invention constitutes an article of manufacture as illustrated in FIG. 19 that may be appropriately packaged and stored for use at some selected time in the future for the purpose of manufacturing a golf shaft having predetermined flexure characteristics. Referring to FIG. 18, the layup procedure is carried out on an appropriate table top (not shown) on which is mounted a jig designated generally by the numeral 86 and having a top marginal rib 87, a bottom marginal rib 88 and a right end abutment piece 89, these three pieces being dimensionally arranged in a predetermined pattern to provide a cavity therebetween within which the layup may proceed. As illustrated at the top of FIG. 18, the ply portion 62 illustrated in FIG. 17 is laid into the cavity so that its upper edge lies next adjacent the member 87. Next, the ply portion 64 is laid into the cavity with its edge 68 overlapping the edge 67 as illustrated. It will be noted that in this initial layup of the first ply the upper edge of the ply is coincident to the lower edge of the member 87 and that the lower edge of the ply is spaced from the inner edge of the lower member 88. It will of course be understood that just prior to the application of the ply portions 62 and 64 as illustrated in FIG. 18, the release paper 34 illustrated in FIG. 11 is removed from the ply portions 62 and 64 and discarded, so that the ply portions 62 and 64 are placed without release paper on the surface of the table within the cavity formed by the jig 86.

In the next step, the second ply of carbon graphite and epoxy is superimposed over the first ply in the cavity but arranged so that the lower edge of the ply lies coincident with the inner edge of the lower member 88 forming the cavity, thus leaving a longitudinal edge portion of each ply exposed, i.e. not covered by the associated ply. As before, the ply portion 72 is laid into the cavity so that its diagonal edge 74 overlaps the diagonal edge 73 of ply portion 71. As will be seen in this illustration, the diagonal edges 73 and 74 are oriented at an angle such that they intersect the diagonal edges 67 and 68 of the underlying ply portions 62 and 64.

In the next step, these two superimposed and now adhered plies are removed from the cavity and flipped over 180° about a longitudinal axis and deposited on the table top so that the second ply 71 now lies next adjacent the table top with the first ply 62 superimposed above it. This results in a longitudinal edge portion 91 of the second ply 71 being left exposed. The third ply 76 constituting the ply containing boron filaments oriented at 0° to the longitudinal dimension of the ply is now applied as illustrated so that it is superimposed and overlaps the exposed edge portion 91 of the ply portion 71. It should be noted that the right end edge 92 of ply 76 lies coincident with the ends of the two previous plies, the length of the boron filament ply 76 being such that the left end 93 terminates in the region of the transitional zone designated generally by the numeral 94 and constituting the region in which the carbon graphite and boron filaments are overlappingly interengaged with the glass filaments contained in ply portions 64 and 72. In what may be the final step of the layup procedure, the fourth ply illustrated in FIG. 17 and constituting the ply 78 formed from carbon graphite fibers orientated at 0° to the longitudinal dimension of the ply, is superimposed over the previously applied boron filament ply 76 in such a manner that the lower edge of the ply 78 lies coincident with the upper edge of ply 62. Because of the relatively wider width of the ply 78, it will be seen that the ply 76 is not only overlapped, but that a portion of the last applied ply 78 extends beyond the upper edge of ply 76 which, in FIG. 18, is illustrated in broken lines in this sub-view.

This sub-assembly illustrated at the bottom of FIG. 18 and constituting the overlapping arrangement of four different plies including two ply portions formed from glass fibers or filaments, two ply portions formed from carbon graphite filaments arranged so that the filaments are angularly disposed in opposite directions in the two plies with relation to the longitudinal dimension of the respective plies, a single ply fabricated from boron filaments arranged in a 0° orientation to the longitudinal dimension of the ply and a fourth ply formed from carbon graphite filaments arranged in a 0° orientation to the longitudinal dimension of the ply constitutes a sub-assembly which forms an article of manufacture which may be appropriately packaged and stored for use at some time in the future in the formation of a golf club shaft. It may even be assembled, which in this sense is intended to include the word "manufactured" and then packaged for sale to other golf club manufactures for processing by them into a final product.

This product or sub-assembly is shown in enlarged form in FIG. 19 with portions broken away to show the orientation of the different layers and the orientation of the filaments in the different layers. Additionally, in FIG. 19 there is optionally added at the left end of the assembly the ply portion 83 illustrated separately at the bottom of FIG. 17 and which is dimensioned so that the right hand edge 96 of the ply portion 83 overlaps the left end edge 97 of ply portion 78 by about one-half inch. Additionally, the top edge 98 of the ply portion 83 is coextensive with the top edge 99 of ply portion 78 while the lower edge 101 of ply portion 83 is coextensive with the lower edge 102 of ply portion 62. In FIG. 19, it will be seen that the lower right hand corner of ply portion 83 has been folded back to reveal the relationship of the underlying plies.

This sub-assembly then is either immediately processed into a completed shaft or packaged and placed into appropriate storage for use at some time in the future. If the sub-assembly which is designated generally by the numeral 103 in FIG. 19 is utilized immediately in the fabrication of a golf shaft, the sub-assembly is taken from the table top on which it was layed up and placed on the lower platen 105' of a rolling table that includes a top platen 105 arranged to move relative to each other so that the top platen 105 moves downwardly into the position indicated in broken lines. The sub-assembly 103 is placed adjacent the rear edge of the lower platen 105' as illustrated in FIG. 21 so that the rear edge of the layup assembly 103 is essentially parallel to the rear edge of the table. To insure this orientation the rear edge of the table may be provided with a lip against which the rear edge of the layup 103 may abut. Next, a steel mandrel 104 constituting an elongated steel core having dimensions complimentary to the internal dimensions of the completed shaft is placed horizontally on the rear edge of the layup 103 and aligned so that the axis of the mandrel is parallel to the edge of the layup. It will be found that when the mandrel is lowered onto the layup, because of the "tacky" consistency of the layup, the mandrel will stick to the marginal edge of the layup and if desired, the mandrel may be rolled forwardly toward the operator one-half turn to insure that the edge portion of the layup is securely adhered to the mandrel. Then, by depressing an appropriate button, the top platen 105 is caused to lower into the position illustrated in FIG. 21 in broken lines so that its forward edge portion overrides and presses downwardly on the mandrel with attached layup. At the end of the downward excursion of the upper platen 105, the lower platen 105' moves rearwardly in the direction of the arrow, causing the mandrel to roll smoothly across the layup 103 so that all plies are simultaniously and/or progressively wound about the mandrel and compressed by the pressure being applied by the upper platen. When the lower platen 105' has completed its lateral displacement the layup assembly 103 will be completely wound on the mandrel and the upper platen will return to its upper position and the lower platen will return to its initial position, leaving the rolled up layup 103 approximately in the center of the lower platen.

After this operation, the wrapped assembly comprising the mandrel wrapped by the layup 103 is wrapped with cellophane tape over its entire length (not shown) and the cellophane wrapped sub-assembly now designated by the numeral 104 in FIG. 22 is suspended in a rack 106 having an upper plate portion 107 slotted to receive the upper end of the mandrel in such a manner that the sub-assembly depends as illustrated. The rack 106 is provided with wheels 108 so that the entire mandrel loaded structure may be rolled into and out of an oven designated generally by the numeral 109. This arrangement is illustrated in FIG. 23 which also illustrates heating elements 112 on opposite sides of the oven walls and heating element 113 adjacent the upper surface of the oven which may be energized to produce a temperature compatible with the epoxy being used to effect hardening and curing thereof during a predetermined time interval. Typically, such curing is effected in two stages, with the first stage temperature being approximately 250° for approximately 30 minutes while the second stage heating increases the temperature to approximately 350° for approximately 60 minutes. After such curing operation, the loaded mandrel rack is removed from the oven and the assemblies are permitted to air cool until each assembly may be handled by hand as illustrated in FIG. 24. As there illustrated, the cellophane wrapping 114 is stripped from the now completed tubular shaft 116 by a knife blade 117. Obviously, the mandrel has previously been removed from the shaft 116. The completed shaft 116 is then trimmed to length as illustrated in FIG. 25 and subsequently polished in a centerless grinder type of polishing device designated generally by the numeral 118.

The curing operation of the cellophane wrapped subassembly results in contraction of the cellophane and consequent compaction of the martrix material in which the filamentary material is embedded. Since the cellophane tape is spirally wound on the wrapped mandrel in overlapping spiral layers, the contraction of the cellophane tape is apt to leave extremely shallow yet visible spiral indentations in the outer layer of the cured shaft. Such spiral indentations may not be removed in the polishing operation illustrated in FIG. 26, and when this occurs, it may be desirable to apply to the exterior surface of the shaft that is completed, the optional fifth ply of material illustrated at the bottom of FIG. 17. This determination is preferably made prior to extraction of the mandrel from the cured tubular shaft. When used, this optional fifth ply is applied in the same manner as the previous plies were applied through use of the rolling table illustrated in FIG. 21. The assembly is then suspended in the oven and cured for a time sufficient to cure and harden this last ply of carbon graphite filamentary material in which the carbon graphite filaments are oriented at 0° to the longitudinal dimension of the shaft.

Referring again to FIG. 17, the dimensional parameters for ply portions 62 and 71 are such that each of these plies will make two complete turns about the mandrel, thus resulting in the provision of four layers by these two plies. The application of the third ply, because of its dimensional parameters, results in the third ply being wrapped around the previous two plies only once, generating the fifth layer in the assembly. In like manner, the fourth ply is dimensioned so that it wraps around the previous plies three full turns, thus providing upon completion of the rolling operation eight complete layers. Where it becomes expedient to apply the optional fifth ply as illustrated in the bottom of FIG. 17, which wraps about the previous layers only once, there will be achieved a completed shaft having 9 complete layers or laminations of material bonded together to form an extremely strong yet light golf shaft. The shaft produced after having been trimmed to appropriate length as illustrated in FIG. 25 is painted with an appropriate polyurethane paint under clean room conditions so as to eliminate any dust specks or particles on the surface of the shaft. The shaft is then ready to submit to quality control procedures and incorporation into a golf club.

Thus, as described above, the completed golf shaft consists of a two media golf shaft, the tip section comprising ply portions 62, 71, 76 and 78 constituting high modulus filamentary material with characteristic impedance ($p_2c_2$). By contrast, the ply portions 64 and 72 are fabricated from low modulus filamentary material ($p_1c_1$), thus producing an interface or boundary between the two different portions of the shaft. As a result of impact of the club head with the ball, stress waves generated at the tip end of the shaft are propagated up the shaft at the acoustic velocity $c_1$. The acoustic velocity in the material can be expressed as $c_1=\sqrt{E_1/p_1}$, where $E_1$ is the elastic modulus of the material and $p_1$ is the mass density of the material. When the stress waves impinge on the boundary of low modulus filamentary material, the energy of the incident wave is divided. Part of the energy is reflected back down the shaft, and the remainder is transmitted into the low modulus butt or grip end of the shaft. The energy intensity ($\alpha_R$) of the reflected wave can be expressed as:

$$\alpha_R = \left(\frac{p_2c_2 - p_1c_1}{p_1c_1 + p_2c_2}\right)^2 .$$

The remainder of the energy is transmitted into the grip section.

In a single material or "media" shaft, $p_1c_1$ equals $p_2c_2$ and hence all the energy, ignoring losses, is transmitted into the grip end of the shaft and contributes to the "feel" quality discussed above. The effect of these stress waves is to cause an unpleasant "feel" in the golfer's hands if the grip is not properly cushioned. In metallic shafts, as indicated above, where energy losses are minimal, a great deal of effort has been expended in designing grips that can attenuate these stress waves before they reach the golfer's hands. Composite shafts have contributed a great deal to lessening the ill effects of these stress waves due to the greater damping characteristics of the resin matrix utilized in forming composite shafts.

From the above however, it will be noted that the subject matter of this invention carries this control of "feel" one step further by combining the benefit of high damping produced by the use of composite materials with the benefit derived from producing an impedance mismatch by utilizing materials having different modulus characteristics, thus resulting in reflecting a portion of the stress wave prior to its reaching the grip end of the shaft.

Having thus described the invention, what is believed to be novel and sought to be protected by Letters Patent of the United States is as follows:

I claim:

1. A golf club comprising:

(a) a club head; and (b) an elongated tubular shaft having a relatively large diameter grip end tapering to a relatively smaller diameter head end attached to said club head, (c) said tubular shaft being formed as one composite member solely from at least two different kinds of non-woven filamentary material, one of said filamentary materials having a relatively low modulus of elasticity and constituting solely said relatively larger diameter grip end of the shaft while the other filamentary material has a relatively significantly higher modulus of elasticity and constituting solely the remainder of the shaft, said relatively larger diameter grip end shaft portion formed from relatively low modulus of elasticity filaments having a relatively higher degree of flexibility than the remainder of said shaft formed from said filamentary material having said higher modulus of elasticity so as to form a hinge point at the intersection of said high and low modulus portions of said shaft, said filamentary material being embedded in heat-hardenable synthetic resinous material and including two portions connected end-to-end in overlapping relationship and bonded together to form a continuous elongated tubular shaft of finite length, each of said two portions including a plurality of layers of said filamentary material.

2. The combination according to claim 1, in which said two tubular shaft portions are of unequal lengths, the shorter of the two shaft portions being formed from said filamentary material having a relatively low modulus of elasticity, a relatively larger diameter and relatively higher degree of flexibility than the other portion.

3. The combination according to claim 1, in which one of said two shaft portions is fabricated from a filamentary material having a relatively low modulus of elasticity equivalent to glass fibers, while the other portion of the shaft is fabricated from a filamentary material having a relatively higher modulus of elasticity equivalent at least to carbon-graphite filaments.

4. The combination according to claim 1, in which one of said two shaft portions comprises a composite of glass fibers and a heat-hardenable epoxy, and the other shaft portion comprises a composite including carbon-graphite filaments and a heat-hardenable epoxy matrix.

5. The combination according to claim 1, in which one of said two shaft portions comprises a composite of glass fibers and a heat-hardenable epoxy, and the other shaft portion comprises a composite including boron filaments and a heat-hardenable epoxy matrix.

6. The combination according to claim 1, in which one of said two shaft portions comprises a composite of glass fibers and a heat-hardenable epoxy, and the other shaft portion comprises a composite of carbon-graphite filaments and boron filaments and a heat-hardenable epoxy matrix.

7. As an article of manufacture, a layup assembly of filamentary material and epoxy for use in forming a composite golf shaft constituting an elongated tapered tube, comprising:

(a) a first ply including a first elongated tapered ply portion narrow at one end and wider at the opposite end and formed from carbon-graphite filamentary material embedded in heat-hardenable resinous material with the filaments angularly orientated to the long dimension of the ply, and a second relatively shorter tapered ply portion complementary in width at its narrow end with the wider end of said first ply portion and formed from glass fibers embedded in heat-hardenable resinous material with the fibers angularly orientated to the long dimension of the ply, the associated wider and narrow end portions of said first and second ply portion being overlapped to form a continuous elongated ply of finite length;

(b) a second ply similar to said first ply except that said filaments are orientated in the opposite direction in relation to the long dimension of the ply, said second ply being superimposed on said first ply so that said second ply overlaps only a portion of the width and the entire length of said first ply;

(c) a third ply comprising an elongated tapered layer of boron filaments embedded in a layer of heat-hardenable resinous material, said boron filaments extending longitudinally of the ply, said ply being superimposed over the edge portion of said second ply left exposed by said first ply, one long edge of said third ply abutting one long edge of said first ply and overlapping one long edge of said second ply, the length of said third ply being approximately the same as the length of said first ply portion of said first ply; and (d) a fourth ply comprising an elongated tapered layer of carbon-graphite filaments embedded in a layer of heat-hardenable resinous material and having a length equal to said third ply, the carbon-graphite filaments possessing a 0° orientation with the longitudinal axis of the ply, said ply being superimposed over and adhered to said third ply and having an edge portion projecting beyond the free edge of said third ply.

8. The combination according to claim 7, in which a sub-portion is provided comprising a layer of glass fibers embedded in a layer of heat-hardenable resinous material, the glass fibers having a 0° orientation to the longitudinal dimension of the sub-portion, said sub-portion being applied over one end of the underlying plies so that the long edges of the sub-portion are coincident with and form an extension of one long edge of the associated fourth ply.

9. The method of producing a composite golf shaft having predetermined flexure characteristics comprising the steps of:

(a) forming into predetermined patterns a plurality of plies of different filamentary materials embedded in a resinous matrix, selected ones of said plies being formed from plyportions of different filamentary materials having different moduli of elasticity while selected other plies are formed totally from a single filamentary material embedded in a resinous matrix;

(b) arranging said plurality of plies into a layup comprising a first ply including a first elongated tapered ply portion narrow at one end and wider at the opposite end and formed from filamentary material having a relatively high modulus of elasticity embedded in heat-hardenable resinous material with the filaments angularly oriented to the long dimension of the ply, and a second relatively shorter tapered ply portion complimentary in width at its narrow end with the wider end of said first ply portion and formed from filamentary fibers having a relatively lower modulus of elasticity embedded in heat-hardenable resinous material with the fibers angularly orientated to the long dimension of the ply, the associated wider and narrow end portions of said first and second ply portions being overlapped to form a continuous elongated ply of finite length, and a second ply similar to said first ply except that said filaments are orientated in the opposite direction in relation to the long dimension of the ply, said second ply being superimposed on said first ply so that said second ply overlaps only a portion of the width and the entire length of said first ply, said layup including a third ply comprising an elongated tapered layer of filaments having a modulus of elasticity higher than said filamentary material having a relatively high modulus of elasticity and embedded in a layer of heat-hardenable resinous material, said filaments extending longitudinally of the ply, said ply being superimposed over the edge portion of said second ply left exposed by said first ply, one long edge of said third ply abutting one long edge of said first ply and overlapping one long edge of said second ply, the length of said third ply being approximately the same as the length of said first ply portion of said first ply, and a fourth ply comprising an elongated tapered layer of filaments similar to the filamentary material in said first and second plies having a relatively high modulus of elasticity and embedded in a layer of heat-hardenable resinous material and having a length equal to said third ply, the filaments possessing a 0° orientation with the longitudinal axis of the ply, said ply being superimposed over and adhered to said third ply and having an edge portion projecting beyond the free edge of said third ply, whereby said filamentary materials of different moduli of elasticity forming said first and second plies overlap in a predetermined area longitudinally of the layup to define a flexure transition and impedance mismatch zone;

(c) wrapping and compacting said layup about a central core symmetrical about a longitudinal axis so that said flexure transition and impedance mismatch zone lies spaced intermediate the ends of the tube thus formed; and (d) subjecting said wrapped tube while on said central core to heat for a time and to a degree sufficient to cure and harden said resinous matrix.

10. The method according to claim 9, in which the filamentary material having the lower modulus of elasticity is positioned adjacent the end of the layup corresponding to the butt or grip end of the club.

11. A golf club comprising:

(a) a head; and (b) an elongated shaft attached at one end to the head, (c) said shaft being formed as one composite member including two portions connected end-to-end and bonded together to form a continuous elongated shaft of finite length, (d) one of said two shaft portions including a first pair of circumferentially superimposed layers of glass fibers embedded in an epoxy matrix, a second pair of circumferentially superimposed layers of glass fibers embedded in an epoxy matrix, said second pair of glass fiber layers being circumferentially superimposed about said first pair of glass fiber layers, the oritentation of said glass fibers in said two pairs of layers being in angularly opposite directions in relation to the longitudinal axis of the shaft, the other of said two shaft portions including a first pair of circumferentially superimposed layers of carbon-graphite filaments embedded in an epoxy matrix, a second pair of circumferentially superimposed layers of carbon-graphite filaments embedded in an epoxy matrix and being circumferentially superimposed about said first pair of carbon-graphite layers, the orientation of said carbon-graphite layers being in angularly opposite directions in relation to the longitudinal axis of the shaft, a fifth layer comprising boron filamentary material embedded in an epoxy matrix and circumferentially surrounding said pairs of layers of carbon-graphite filaments, the boron filaments extending lengthwise of the shaft in a 0° orientation with the longitudinal axis thereof, and a set of three layers circumferentially wound about said longitudinal axis and superimposed about said boron filaments and comprising carbon-graphite filamentary material embedded in an epoxy matrix, the carbon-graphite filaments possessing a 0° orientation with the longitudinal axis of the shaft.

12. The combination according to claim 11, in which said first mentioned shaft portion formed from multiple layers of glass fibers arranged in pairs of layers in which the fibers are oppositely orientated includes a set of three layers of glass fibers wound circumferentially about and superimposed on said pairs of layers, the glass fibers in said set of three layers possessing a 0° orientation with the longitudinal axis of the shaft.

13. The combination according to claim 11, in which said first mentioned shaft portion is approximately one-third the length of the entire shaft, constitutes the large diameter end portion of the shaft, and possesses a lower modulus of elasticity than the remainder of the shaft.

* * * * *